United States Patent [19]

Lin

[11] Patent Number: 4,578,551

[45] Date of Patent: Mar. 25, 1986

[54] OPERATING MECHANISM FOR ELECTRICAL SWITCHES

[75] Inventor: Chester H. Lin, Skokie, Ill.

[73] Assignee: S&C Electric Company, Chicago, Ill.

[21] Appl. No.: 721,613

[22] Filed: Apr. 10, 1985

[51] Int. Cl.[4] ..... H01H 3/00

[52] U.S. Cl. ..... 200/153 SC; 200/320; 200/153 LB; 74/2; 185/37; 251/74; 251/89

[58] Field of Search ..... 200/153 SC, 153 W, 318, 200/320, 323–325, 61.62, 61.53, 153 LB; 74/2; 185/37, 39; 251/66, 74, 89, 111, 114, 263

[56] References Cited

U.S. PATENT DOCUMENTS

| | | | |
|---|---|---|---|
| 2,023,235 | 12/1935 | LeCount | 185/37 |
| 2,846,621 | 8/1958 | Coggeshall et al. | 200/153 SC |
| 3,875,360 | 4/1975 | Rys | 200/153 SC |

FOREIGN PATENT DOCUMENTS

| | | | |
|---|---|---|---|
| 2018906 | 11/1971 | Fed. Rep. of Germany | 185/39 |

*Primary Examiner*—Stephen Marcus
*Assistant Examiner*—Linda J. Sholl
*Attorney, Agent, or Firm*—James V. Lapacek

[57] ABSTRACT

An improved operating mechanism is provided for controlling the operational state of an electrical switch or interrupter between open and closed positions. The operating mechanism includes a switch operating member that is selectively movable in switch-opening and switch-closing directions to effect opening and closing of the switch. The operating mechanism stores energy to selectively close the switch and to immediately thereafter be capable of opening the switch as required. A carriage is driven to charge an opening spring and a closing spring while the switch operating member remains latched in a stationary position. The closing spring acts between the carriage and the switch operating member. The opening spring acts between the carriage and the frame or housing of the operating mechanism. An independent latch is provided for each of the switch operating member and the carriage; each of the latches directly operating on a respective one of the switch operating member or the carriage. To close the switch, the latch for the switch operating member is tripped to release the stored energy in the closing spring which acts to move the switch operating member to the switch-closed position. An arrangement is provided for moving the switch operating member in the switch-opening direction in response to movement of the carriage in a direction opposite to that of charging. In a specific embodiment, the arrangement includes the carriage directly acting against the switch operating member. When it is desired to open the switch, the latch for the carriage is tripped to release the stored energy in the opening spring which acts through the carriage to move the switch operating member to the switch-open position. The carriage and the switch operating member each move with respect to an axis, the axes being coincident.

28 Claims, 6 Drawing Figures

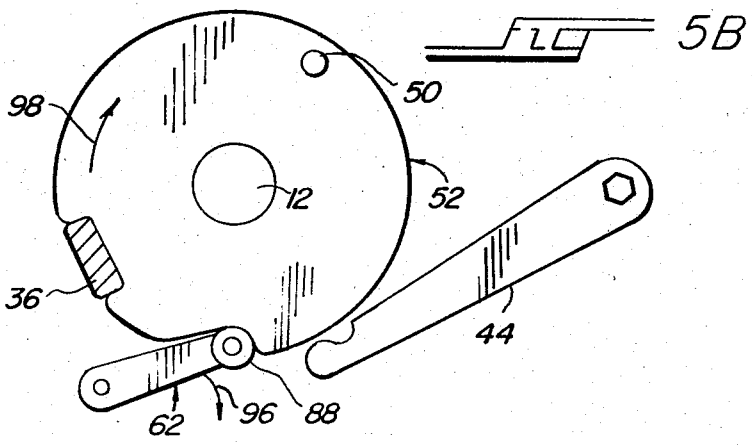
5B
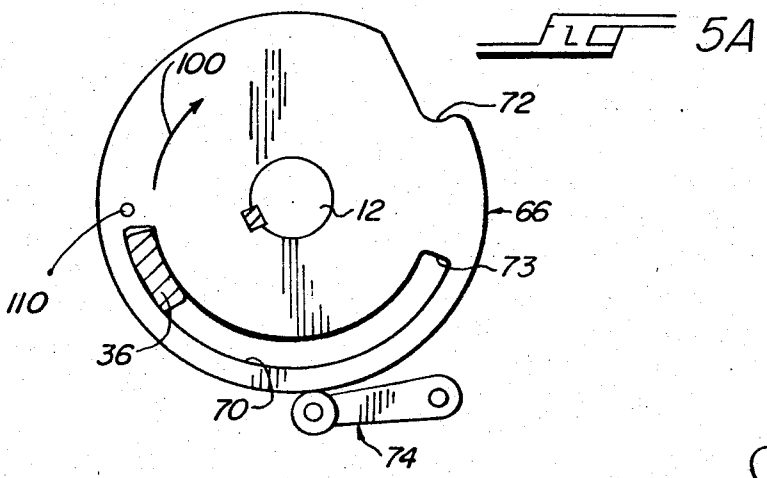
5A
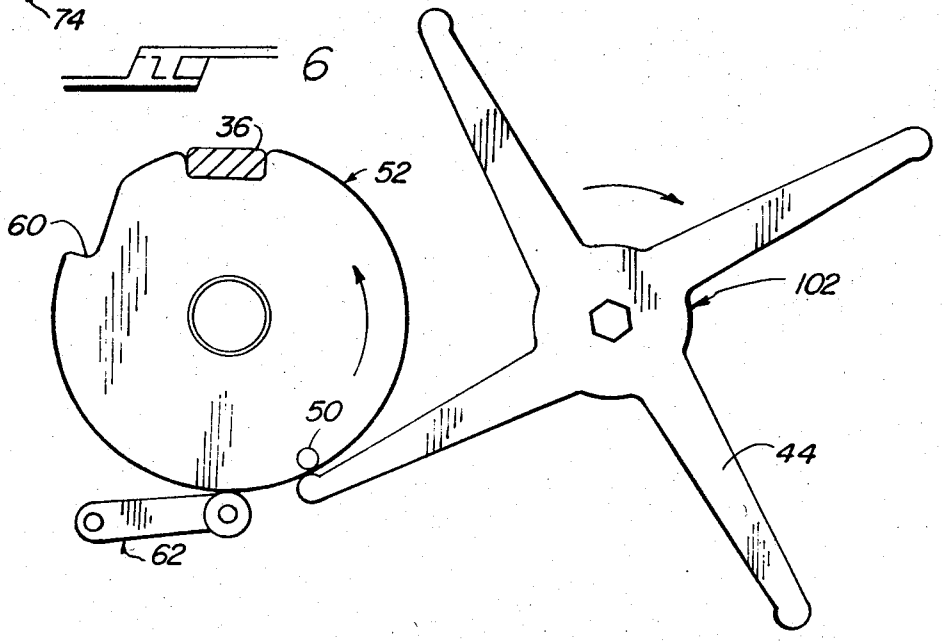
6

OPERATING MECHANISM FOR ELECTRICAL SWITCHES

CROSS-REFERENCE TO RELATED APPLICATION

This application is related to commonly-assigned, co-pending application Ser. No. 721617 filed in the names of Walter J. Hall et. al. on 4/10/85 which discloses and claims a linear operating mechanism of the basic type disclosed and claimed herein.

BACKGROUND OF THE INVENTION

1. Field of the Invention

The present invention relates generally to operating mechanisms and more particularly to an improved mechanism for electrical switches that utilizes a carriage to charge an opening spring and a closing spring and that includes an arrangement to selectively close the switch and to immediately thereafter be capable of opening the switch as required.

2. Description of the Related Art

Various operating mechanisms are utilized to operate switches and the like between open and closed positions. In particular, operating mechanisms are desirable for switch applications that store operating energy to selectively close a switch and to immediately thereafter be capable of opening the switch as required.

A first variety of operating mechanism provides for the charging of an opening spring during the switch closing operation. Examples of this type of mechanism are disclosed in the following U.S. Pat. Nos. 4,453,056; 4,121,077; 4,105,878; 3,898,409; 3,845,263; 3,835,277; 3,784,764; 3,728,508 and 3,600,541. This type of operating mechanism requires a higher-capacity closing spring to perform the functions of both closing the switch and charging the opening spring. The requirement of a higher-capacity closing spring is, of course, undesirable since it also requires higher-capacity latching, driving and supporting arrangements, as well as high speed latch engagement for the opening components.

Another variety of operating mechanism requires the detaching of the closing spring from the operating member during switch opening. This type of operating mechanism requires a relatively complex arrangement for the required detaching of the closing spring. U.S. Pat. No. 3,876,847 discloses an arrangement that sequentially charges the closing spring and then the opening spring; the arrangement also including the detaching of the closing spring during switch opening.

An operating mechanism that avoids some of the drawbacks of the aforementioned approaches is disclosed in U.S. Pat. No. 4,124,790. The arrangement as seen in FIGS. 5 and 8 of that patent includes a closing spring 75 connected between a drive lever assembly 70 and the frame, and an opening spring 76 connected between the drive lever assembly 70 and a switch operating lever assembly 69. The springs 75 and 76 are charged by movement of the drive lever assembly 70. A separately biased, toggle lever assembly 71 acts between a pivotal lever arm 77 of the switch operating assembly 69 and a pivotal lever arm 123 of the drive lever assembly 70. The pivotal lever arm 77 is connected through linkage 72 to operate a switch. When the springs are charged, the drive lever arm 123 is latched by a plate 147. The toggle lever assembly 71 is latched by means of a latch that is operative to maintain the pivotal toggle arms 95 and 97 of the assembly 71 in the latched position The lever arm 77 is held in position by the latched, toggle arms 95,97 acting against the latched drive lever arm 123. To close the switch, the drive lever arm 123 is unlatched, whereupon the closing spring 76 pivots the arm 123 counterclockwise with the lever arm 77 being correspondingly pivoted counterclockwise through toggle arms 95,97. The pivoting of the lever arm 77 closes the switch. To open the switch, the latch on the toggle arms 95,97 is released. As the toggle arms 95,97 collapse, the opening spring 76 pivots the lever arm 77 in the clockwise direction. This configuration is complex and is neither suitable nor desirable for many applications. For example, the switch operating drive lever assembly 69 is only indirectly latched through the collapsable toggle lever assembly 71. Further, the arrangement to latch the toggle lever assembly 71 is complex and requires a latching element that operates against moving latching surfaces. Accordingly, the arrangement in U.S. Pat. No. 4,124,790 includes complex, indirect latching and a complex arrangement to transmit force and movement from the drive lever member 123 to the switch operating member 77.

U.S. Pat. Nos. 3,913,459, 3,835,277 and 3,646,292 disclose the advantageous use of ring latches for releasably restraining a movable member in operating mechanisms and other apparatus.

While the aforementioned arrangements are generally useful and satisfactory for their intended use, it would be desirable to provide an improved operating mechanism with improved operational features.

SUMMARY OF THE INVENTION

Accordingly, it is a principal object of the present invention to provide an improved operating mechanism for electrical switches that includes a switch operating member and a carriage that are each selectively latchable and movable with respect to an axis, the carriage being moved in a first direction to charge an opening spring and a closing spring, the carriage when moving in a second direction acting directly to move the switch-operating member in a switch-opening direction, the latching arrangements operating directly on the carriage and the switch operating member.

It is another object of the present invention to provide an operating mechanism that stores energy to selectively close a switch and to immediately thereafter be capable of opening the switch as required, the operating mechanism including a carriage that is moved to charge an opening spring and a closing spring; the carriage and a switch operating member each moving with respect to a common axis.

It is a further object of the present invention to provide an improved operating mechanism for electrical switches that utilizes movement of a carriage in a first direction to store operating energy; the carriage and a switch-operating member being coaxially arranged with the switch operating member being movable in two opposite directions corresponding to switch-closing and switch-opening movement.

It is another object of the present invention to provide an improved operating mechanism for operating a switch where the operating mechanism includes a carriage that is driven to charge an opening spring and a closing spring, wherein the closing spring acts between the carriage and the switch operating member, the opening spring acts between the carriage and the frame or housing of the operating mechanism, and the carriage acts directly on the switch operating member to move the switch operating member for switch-opening movement when the carriage moves in a sense opposite to the movement of the charging movement.

Briefly, in accordance with important aspects of the present invention, there is provided an improved operating mechanism for controlling the operational state of an electrical switch or interrupter between open and closed positions. The operating mechanism includes a switch operating member that is movable in switch-opening and switch-closing directions to effect opening and closing of the switch. The operating mechanism stores energy to selectively close the switch and to immediately thereafter be capable of opening the switch as required. A carriage is driven to charge an opening spring and a closing spring while the switch operating member is latched in a stationary position. The closing spring acts between the carriage and the switch operating member. The opening spring acts between the carriage and the frame or housing of the operating mechanism. An independent latch is provided for directly operating on each of the switch operating member and the carriage. To close the switch, the latch for the switch operating member is tripped; thereby releasing the switch operating member upon which the stored energy in the closing spring acts to move the switch operating member to the switch-closed position. An arrangement is provided for moving the switch operating member in the switch-opening direction in response to movement of the carriage in a direction opposite to that of charging. In a specific embodiment, the arrangement includes the carriage being adapted to positively act against the switch operating member. When it is desired to open the switch, the latch for the carriage is tripped to release the carriage upon which the stored energy in the opening spring acts; the carriage acting upon the switch operating member to move the switch operating member to the switch-open position. The switch operating member and the carriage each move with respect to an axis, the axes being coincident.

In a specific arrangement, the movement of the carriage and the operating member is rotary and the opening and closing springs are spiral springs. The arrangement for moving the switch operating member in the switch opening direction in response to movement of the carriage in a direction opposite to that of the charging movement includes the carriage bearing against a drive member attached to the switch operating member. The drive member also functions as a cam member for a latch and is also referred to hereinafter as a closing cam member.

BRIEF DESCRIPTION OF THE DRAWING

The invention, both as to its organization and method of operation, together with further objects and advantages thereof, will best be understood by reference to the following specification taken in conjunction with the accompanying drawing in which like reference numerals refer to like elements and in which:

FIGS. 3, 4, and 5 are elevational views of positions of the operating mechanism illustrating the respective operational states: FIG. 3—switch open, springs discharged; FIG. 4—switch open, springs charged; and FIG. 5—switch closed, opening springs charged, closing spring discharged; and FIG. 6 is an elevational view illustrating an alternate charging arrangement for use with the operating mechanism of FIG. 1.

DETAILED DESCRIPTION

Figure 1:
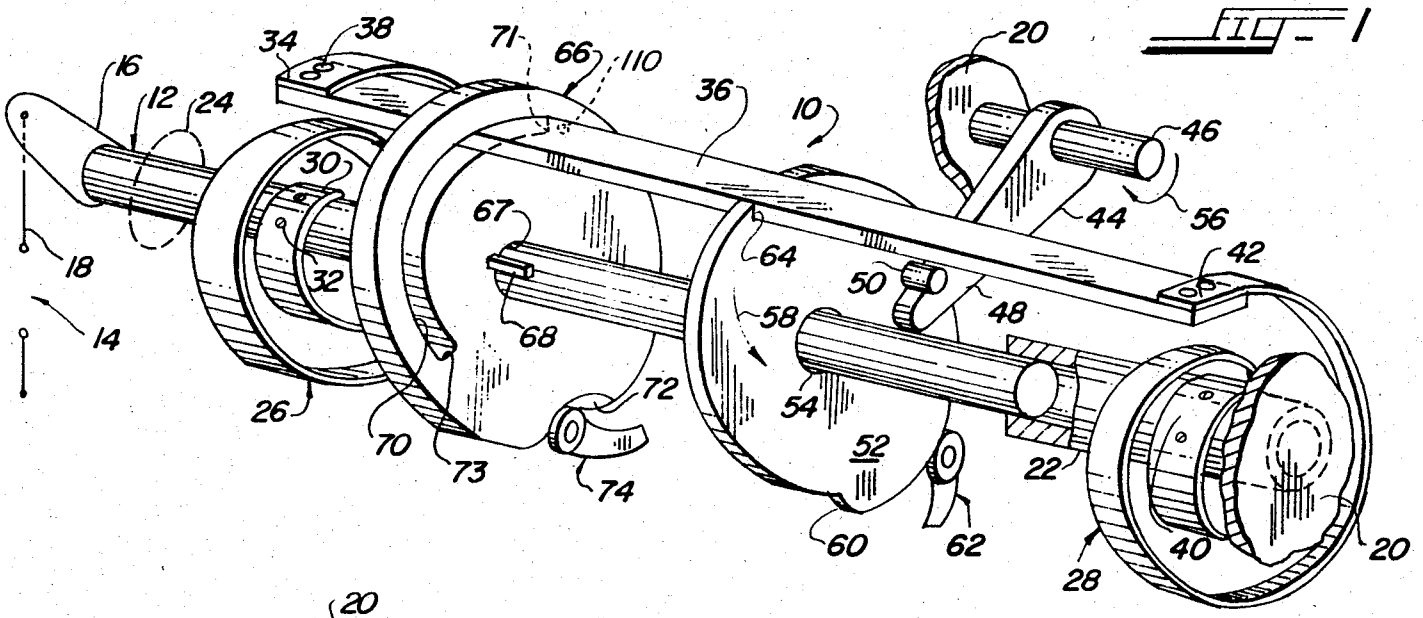
FIG. 1 is a perspective view of the operating mechanism of the present invention for operation of an electrical switch.
Figure 2:
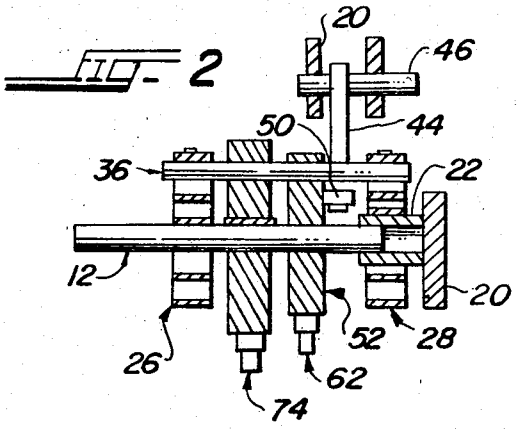
FIG. 2 is an elevational view partly in section of the operating mechanism of FIG. 1.

Referring now to FIGS. 1 and 2, the operating mechanism 10 of the present invention includes an output shaft 12 that functions as an operating member. Rotation of the output shaft 12 defines two operating positions that correspond to the open and closed positions of an electrical switch represented in FIG. 1 at 14. The switch 14 is one application of the operating mechanism 10 represents the contacts of one or more interrupter switches. In FIG. 1, the control linkage between the contacts of the switch 14 and the output shaft 12 is illustrated by a member 16 extending generally perpendicular from the output shaft 12 and linkage between the member 16 and the switch 14 represented generally at 18. However, it should be understood that various control linkages are provided in other applications and specific arrangements. Where the electrical switch is operated in a rotary fashion, the output shaft 12 may be directly connected to operate the switch. It should also be understood that while the present invention is illustratively described for operating a switch, in other arrangements the operating mechanism is applied to operate valves, gates, etc., especially where a rapid-reversal of a specific operative state is required. Further, the operating mechanism 10 may be arranged with a reversal of the open and closed operating sequence.

In accordance with the features of the present invention, the operating mechanism 10 receives a unidirectional charging input in the direction 58 and, as desired thereafter, the operating mechanism 10 is selectively operable to close the switch 14 via movement of the operating member output shaft 12 in a first direction, and is immediately thereafter capable of being selectively operable to open the switch 14 via movement of the operating member output shaft 12 in a second direction, opposite to that of the first direction. This provides a trip-free or release-free operation; i.e. the operating mechanism is immediately available to open the switch after closing without the intervention or requirement of additional force inputs or control cycles.

The output shaft 12 is rotatably mounted with respect to a frame 20 by means of a bearing shaft 22 extending from the frame 20. In specific embodiments, one or more other support bearings represented at 24 are provided for suitable support from the frame 20. The operating energy for movement of the output shaft 12 of the operating mechanism 10 is stored in a spiral closing spring 26 and a spiral opening spring 28. One end 30 of the closing spring 26 is fixedly carried by the output shaft 12 by suitable fasteners or attachment means indicated at 32. The second, outer end of the closing spring 26 is fixedly connected at 34 to a carriage 36 which, in the specific implementation of FIG. 1, takes the form of an elongated bar. The outer end of the closing spring 34 is affixed to the carriage 36 by suitable attachment means represented at 38. The opening spring 28 at an inner end 40 is fixedly attached to the support shaft 22. The outer end 42 of the opening spring 28 is fixedly attached to the carriage 36.

A spring charging cam 44 is provided to charge the closing spring 26 and the opening spring 28 with switch closing energy and switch opening energy respectively.

However, it should be understood that the operating mechanism may be suitably charged by various other arrangements. The spring charging cam 44 is rotatably supported with respect to the frame 20 via a spring charging shaft 46. The spring charging shaft 46 is rigidly attached to the spring charging cam 44. The spring charging cam 44 is generally tapered in shape and includes an outer end 48 opposite the shaft 46 that is arranged to contact a cam follower pin 50 or other suitably shaped element fixedly carried and extending from an opening cam member 52. The opening cam member 52 is rotatably mounted about the output shaft 12 via central opening 54.

Upon rotation of the spring charging shaft 46 in the clockwise direction 56, the charging cam 44 at 48 operates against the pin 50 to rotate the opening cam member 52 in a counterclockwise direction illustrated by arrow 58. The opening cam member 52 along an outer circumferential surface includes a detent 60 for cooperation with a roller latch 62. The roller latch 62 is selectively operable to latch the opening cam member 62 or to release the cam member for reasons as will be explained in more detail hereinafter. The opening cam member 52 also includes a receiving notch 64 adapted to receive the carriage 36. Accordingly, upon rotation of the charging shaft 46, the opening cam member 52 carries the carriage 36 for movement with notch 64 of the opening cam member 52.

The operating mechanism 10 further includes a closing cam member 66 fixedly carried by the output shaft 12. For example, the output shaft 12 passes through a central opening 67 in the cam member 66 and a key 68 is inserted within a keyway 69 in the central opening 67 of the cam member 66. The opening cam member 66 includes an arcuate aperture 70 for receiving the carriage 36. The circumference of the closing cam member 66 also includes a cam surface with a detent 72 that cooperates with a roller latch 74. The roller latch 74 is selectively operable to latch the cam member 66 or to release the cam member for reasons as will be explained in more detail hereinafter.

While the members 52 and 66 are referred to as an opening cam member and a closing cam member 66 respectively, it should be realized that while each member includes a cam surface and detent for cooperation with a roller latch, the members 52 and 66 also function as drive or control members. Further, the closing cam member 66 can also be considered a widened portion of the output shaft 12. Accordingly, while the members 52 and 66 can be referred to by various terms, their functions remain as described herein. Further, as will be realized by those skilled in the art, in specific embodiments the latch function and the drive control function of each of the members 52,66 as described herein is provided by separate elements.

Figure 3B:
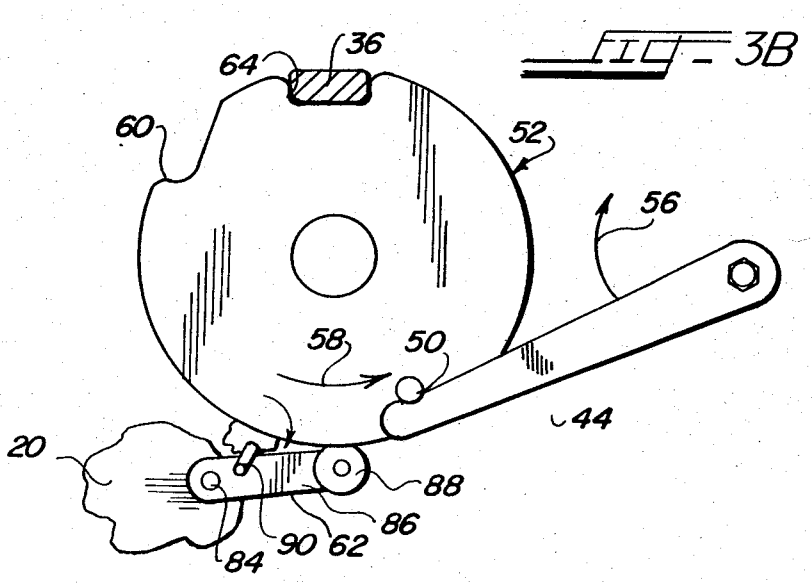
Figure 3A:
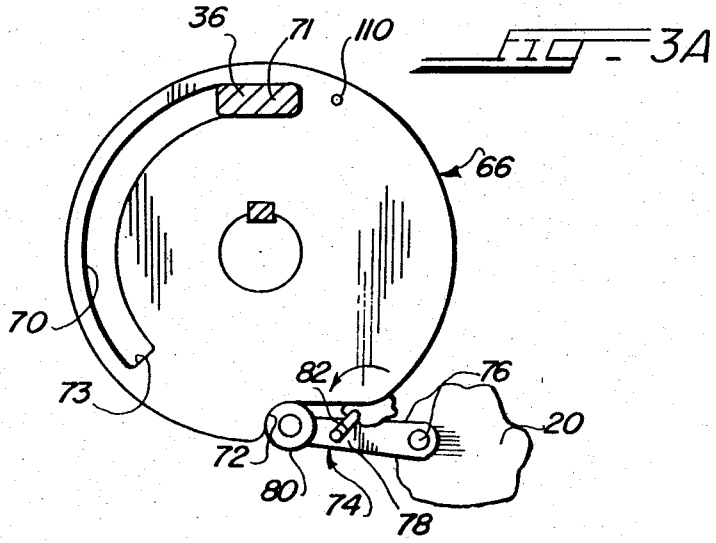

Considering now the detailed operation of the operating mechanism 10 and referring additionally to FIG. 3, the closing cam member 66 and the opening cam member 52 are illustrated in the relative positions as in FIG. 1. The relative positions correspond to the switch 14 being in the open position and the closing spring 26 and the opening spring 28 being discharged. The carriage 36 is arranged at a first end 71 of the aperture 70. As can be seen from FIG. 3, the roller latch 74 is rotatably mounted at 76 with respect to the frame 20 and includes a latch arm 78 extending from the rotatable mounting point 76. The latch arm 78 carries a rotatably mounted roller 80. When the switch 14 is open, the springs are in the discharged condition and the latch 74 is in the latch secured position, the roller 80 in the detent 72 prevents the closing cam member 66 from rotating which, in turn, prevents the output shaft 12 from rotation. The latch arm 78 is biased in the clockwise direction in the latching position. A latch trip lever 82 is selectively rotatable in the counterclockwise direction to rotate the latch arm 82 away from engagement with the closing cam member 66. However, it should be understood that other suitable trip mechanisms are also utilized in other specific embodiments. In any case, when the latch trip 82 is operated, the latch arm 78 is rotated counterclockwise about the pivot 76 and the closing cam member 66 is released for movement in accordance with the relative rotational forces applied to the carriage 36 and to the output shaft 12.

Considering now the opening cam member 52 of FIG. 3, the roller latch 62 includes a latch arm 86 that is rotatably biased at pivot 84 with respect to the frame 20 in the counterclockwise direction in the latching postiion. The latch arm 86 carries a rotatably mounted roller 88 at the end of the latch arm 86 opposite the pivot 84. A latch trip lever 90 is selectively rotatable in the clockwise direction to rotate the latch arm 90 away from engagement with the opening cam 72. In a subsequently discussed position of the opening cam member 52 wherein the latch arm 86 latches the cam member 52 against movement by engagement with the cam portion 60, rotation of the trip lever 90 moves the latch arm 86 to release the opening cam member 52. In the position of FIG. 3, when the switch 14 is opened and the springs are discharged, the opening cam member 52 is free for movement. Accordingly, when the spring charging cam 44 is rotated, the opening cam member 52 via pin 50 is rotated in a counterclockwise direction.

Figure 4B:
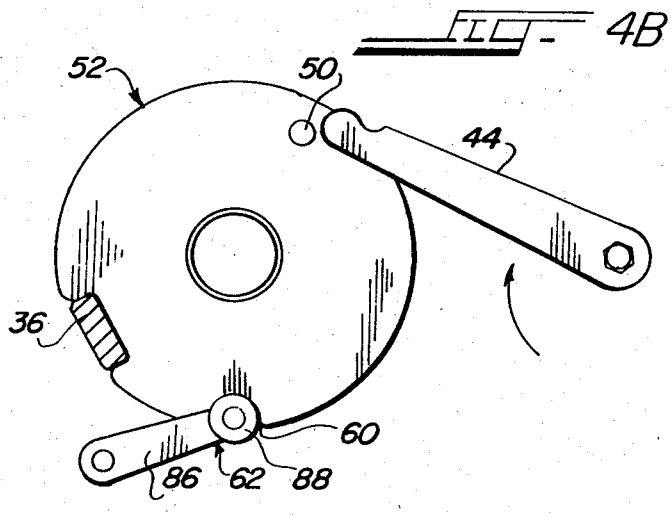
Figure 4A:
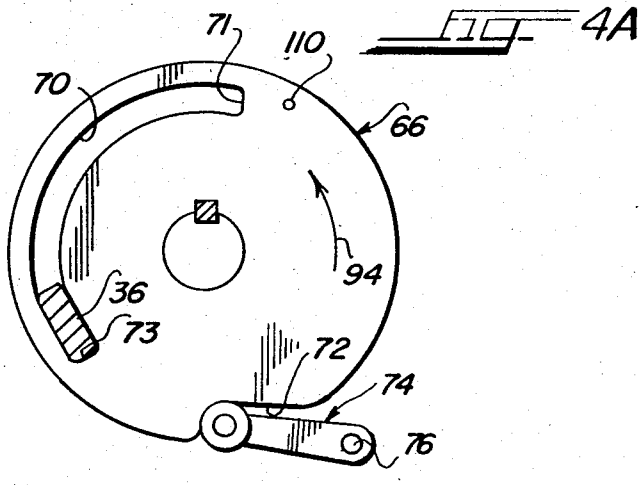

With continued rotation of the charging cam 44, and referring now to FIG. 4, the opening cam member 52 is rotated to a position wherein the latch 62 moves into the detent 60 to retain the opening cam member 52 as the charging cam 44 clears the pin 50 and rotation of the opening cam member 52 ceases. The closing cam member 66 is held in a fixed position by the latch 74. Accordingly, as the carriage 36 is carried along with rotational movement of the opening cam member 52, the carriage 36 moves from the first end 71 of the aperture 70 of the closing cam member 66 to the second end 73 as shown in FIG. 4. As the carriage 36 moves to the position as shown in FIG. 4, and with the output shaft 12 prevented from rotating, the closing spring 26 and the opening spring 28 are each charged; i.e. the springs 26 and 28 have energy stored therein as the respective outer spring ends 34 and 42 are rotated counterclockwise about the output shaft 12 with respect to the unmoving respective inner ends 30 and 40 of the springs. At this point, the switch 14 is still open since the output shaft 12 has not changed position. However, both the closing spring 26 and the opening spring 24 have operating energy stored therein. The charging cam 44 either continues in clockwise rotation to a reset point ready for subsequent charging or, in the alternative, is rotated counterclockwise for resetting for the next charging operation. Accordingly, in FIG. 5, the charging cam 44 is shown in the reset position ready for charging.

When it is desired to close the contacts 14, the latch 74 is released via operation of the trip arrangement 82 whereupon the closing cam member 66 rotates in a counterclockwise direction shown at 94 under the spring force of the closing spring 66. The inner spring end 30 acts to rotate the output shaft 12 against the fixed outer end 34 that is attached to the carriage 36 which is held in a fixed position since the opening cam member 52 is latched by the latch 62. Referring now to FIG. 5, the closing cam member 66 has rotated in a counterclockwise direction to close the switch 14 with the closing cam member 66 assuming a position that corresponds to the closing spring 26 being discharged. Accordingly, the carriage 36 is now at the first end 71 of the aperture 70. The position of the opening cam member 52 is unchanged during the switch closing operation from FIG. 4 to FIG. 5. Further, the opening spring 28 retains the original charge imparted during the spring charging operation; the stored energy therein is unchanged during the switch closing operation.

When it is desired to open the switch 14, the latch 62 is released by operation of the trip arrangement 90 to move the latch lever 88 in the direction as shown at 96. The opening cam member 52 is freed to rotate about the operating shaft 12 in a clockwise direction shown at 98 in accordance with the spring force of the opening spring 28 that is imparted to the opening cam member 52 by the carriage 36 and through the outer end 42 of the opening spring 28 with respect to the frame 20. As the opening spring 28 uncoils and the outer end 42 moves to the uncharged position, the closing cam member 66 is also driven in a clockwise direction at 100 due to the carriage 36 acting against the cam member 66 at 71. The output shaft 12 is rotated by the closing cam member 66 and the switch 14 is opened to result in the configuration of FIG. 3. When each of the latches 62 and 74 are tripped, the trip arrangement is operated only momentarily and the latches return to their biased positions. During the switch opening operation from FIG. 5 to FIGS. 1 and 3, both the outer end 34 and the inner end 30 of the closing spring 26 are simultaneously moved such that the uncharged status of the closing spring 26 is maintained throughout the opening operation; i.e. the inner and outer ends of the spring 26 experience no relative movement with respect to each other.

The operating mechanism 10 after the charge, close and open sequence is in the position of FIGS. 1 and 3 with the switch 14 in the open position and the springs 26 and 28 in a discharged condition. Thus, the operating mechanism 10 is ready for charging by the operation of the cam 44 for another sequence of switch closing and switch opening operation.

Referring now to FIG. 6, an alternate spring charging cam 102 includes four radially extending and circumferentially disposed charging cams 44. One rotation of the cam 102 corresponds to four charging cycles, one for each of the charging cams 44. The alternate spring charging cam arrangement 102 does not require any resetting as discussed hereinbefore in connection with the cam 44 of FIGS. 1 through 5.

While the operating mechanism described hereinbefore with respect to FIGS. 1 through 6 is desirable and entirely suitable for many types of switch operating mechanisms and may be preferred for certain applications such as rotary actuated switches where rotation of the output shaft 12 directly operates the switch 14, the present invention can also be practiced and implemented by linear configurations. For example, the operating member 12 and the carriage 36 move linearly and the closing spring 26 and the opening spring 28 are linear springs. In such a linear implementation, the latches can be directly operable on the operating member 12 and the carriage 36. A linear operating mechanism that operates in accordance with the basic principles of the present invention and that may be preferred for certain applications is disclosed and claimed in copending application Ser. No. 721,617, filed in the names of Walter J. Hall, et. al. on 4/10/85 to which reference may be made for a more detailed description. A linear implementation may be preferred due to the required operating force for the controlled switch or switches, due to the switch having a linearly acting operating member, or because a group of switches are to be commonly controlled through linkage which is more suitably driven by a linearly acting member.

While there has been illustrated and described various embodiments of the present invention, it will be apparent that various changes and modifications will occur to those skilled in the art. For example, in specific embodiments, the springs 26 and 28 may be implemented by hydraulic or pneumatic cylinders or other energy storing component that is suitable for the application. Further, in other specific embodiments, the roller latches 62 and 74 can be implemented by other latch configurations. Additionally, in an alternative arrangement, the closing spring 26 is positioned between the closing cam 66 and the opening cam 52. In that arrangement, the carriage 36 need not extend through the closing cam 66; the carriage 36 and the closing cam 66 being adapted for transferring rotation of the carriage 36 to the closing cam 66. For example, the closing cam 66 is one specific embodiment is provided with a protuberance at 110 that is engaged by the carriage 36 during opening of the switch 15 as represented by the sequence of FIG. 5 to FIG. 3. It should also be realized that in other specific arrangements, the various components can be arranged in a variety of sequences relative to each other. It is intended in the appended claims to cover all such changes and modifications as fall within the true spirit and scope of the present invention.

What is claimed and desired to be secured by Letter Patent of the United States is:

1. An operating mechanism for an electrical switch, the operating mechanism being capable of immediately reopening the switch after its closure, the operating mechanism comprising:

a frame;

a carriage movable between first and second positions;

a switch operating member to effect opening and closing of a switch and being movable between respective first and second positions;

switch-closing energy storage means acting between said switch operating member and said carriage for storing switch-closing energy;

switch-opening energy storage means acting between said carriage and said frame for storing switch-opening energy;

first selectively releasable latch means for selectively preventing switch-closing movement of said switch operating member whenever the switch is open;

second selectively releasable latch means for selectively preventing movement of said carriage from said second position to said first position, said carriage being moved from said first position to said second position to store energy in said switch-closing energy storage means and said switch-opening energy storage means while said switch operating member is latched by said first selectively releasable means in said first position corresponding to the switch-open position, said carriage being latched by said second selectively releasable latch means when said carriage reaches said second position, subsequent release of said switch operating member by said first selectively releasable latch means causing said switch operating member to move from said first position to said second position corresponding to the switch-closed position, subsequent release of said carriage by said second selectively releasable latch means causing said carriage to move from said second position to said first position; and means for moving said switch operating member from said second position to said first position in response to movement of said carriage from said second position to said first position.

2. The operating mechanism of claim 1 wherein said carriage and said switch operating member are movable with respect to a common axis.

3. The operating mechanism of claim 2 wherein said first selectively releasable latch means operates directly on said switch operating member.

4. The operating mechanism of claim 3 wherein said moving means is independent of said first selectively releasable latch means.

5. The operating mechanism of claim 4 wherein said moving means comprises means carried by said switch operating member for engaging said carriage.

6. The operating mechanism of claim 4 wherein said moving means comprises means carried by said carriage for engaging said switch operating member.

7. The operating mechanism of claim 4 wherein said moving means comprises cooperating portions of said carriage and said switch operating member.

8. The operating mechanism of claim 1 wherein said switch-closing energy storage means is a closing spring and said switch-opening energy storage means is an opening spring.

9. The operating mechanism of claim 8 wherein said carriage comprises an elongated carriage member, said switch operating member comprising an operating shaft rotatably mounted with respect to said frame, said elongated carriage member being arranged generally parallel to said operating shaft and being movable in a rotary path about said operating shaft, said switch operating member further comprising a drive member fixedly carried by said operating shaft and including means for receiving said elongated carriage member whenever the switch is closed and said carriage is in said second position.

10. The operating mechanism of claim 9 wherein said first latch means includes a latch member and a latch receiver provided on said drive member for cooperation with said latch member.

11. The operating mechanism of claim 10 wherein said latch receiver is a detent and said latch member is a latch arm including a roller.

12. The operating mechanism of claim 11 further comprising an cam member rotatably mounted with respect to said operating shaft and including a receiving notch cooperating with said elongated carriage member such that rotation of said cam member in a first predetermined direction rotates said elongated carriage member with respect to said operating shaft from said first to second position to charge said opening spring and said closing spring.

13. The operating mechanism of claim 12 wherein said second latch means comprises a latch member and a detent provided on said cam member and cooperating with said latch member.

14. The operating mechanism of claim 13 further comprising a charging receiver carried by said cam member and a charging lever for engaging said charging receiver and rotating said cam member.

15. The operating mechanism of claim 9 wherein said receiving means of said drive member comprises an arcuate aperture.

16. The operating mechanism of claim 9 wherein said opening spring and said closing spring are spiral springs.

17. An operating mechanism for a switch, the mechanism being of the type capable of storing energy to selectively close the switch when it is open, and being capable of immediately reopening the switch after its closure if such reopening is required, the mechanism opening and closing the switch by moving an operating member thereof in switch-opening and switch-closing directions; the mechanism comprising:

a frame;

a carriage movable in first and second opposed directions between first and second locations;

a first selectively releasable latch for preventing switch-closing movement of the operating member whenever the switch is open;

a first spring which acts between the carriage and the operating member so that movement of the carriage in the first direction while the first latch prevents switch-closing movement of the operating member stores therein switch-closing energy;

a second selectively releasable latch for preventing movement of the carriage in the second direction whenever the carriage has moved to the first location to store a selected amount of switch-closing energy in the first spring;

a second spring which acts between the carriage and the frame so that movement of the carriage to the first location stores therein a selected amount of switch-opening energy which biases the carriage in the second direction; and means for moving the operating member in the switch-opening direction in response to movement of the carriage in the second direction from the first to the second location whenever the switch is closed.

18. An operating mechanism for driving a switch between first and second operating positions, the mechanism being capable of storing energy to selectively drive the switch from the first operating position to the second operating position, and being capable of immediately thereafter driving the switch to the first operating position, the operating mechanism comprising:

a frame;

a carriage movable between first and second positions;

a switch operating member to drive the switch and being movable between respective first and second positions, said carriage and said switch operating member each being movable with respect to a common axis;

a first spring acting between said switch operating member and said carriage;

a second spring acting between said carriage and said frame;

first means for selectively latching said switch operating member against movement with respect to said frame;

second means for selectively latching said carriage against movement with respect to said frame; and means for moving said switch operating member from said second position to said first position in response to movement of said carriage from said second position to said first position.

19. The operating mechanism of claim 18 wherein said carriage and said switch operating member are each movable about a common axis.

20. The operating mechanism of claim 18 wherein said first selective latching means comprises means for directly acting on said switch operating member, said moving means being independent of said first selectively latching means.

21. The operating mechanism of claim 18 wherein said first and second springs are charged with operating energy as said carriage is moved from said first position to said second position with said switch operating member being latched in said first position corresponding to the switch-open position.

22. The operating mechanismm of claim 21 wherein said carriage is latched in said second position by said second selective latching means, subsequent release of said switch operating member by said first selective latching means causing said switch operating member to move to said second position corresponding to the switch-closed position.

23. The operating mechanism of claim 22 wherein subsequent release of said carriage by said second selective latching means causing said switch operating member to move to said first position.

24. The operating mechanism of claim 18 wherein said first and second springs are compression springs.

25. The operating mechanism of claim 18 wherein said carriage is movable in a first direction to charge said opening and closing springs, said switch operating member during operation being movable in said first direction and in the opposite direction.

26. An operating mechanism for a switch comprising:

a frame;

a carriage movable between first and second positions;

a switch operating member to effect opening and closing of a switch and being movable between respective first and second positions;

a closing spring acting between said switch operating member and said carriage;

an opening spring acting between said carriage and said frame;

means for selectively latching each of said switch operating member and said carriage against movement with respect to said frame, said carriage moving from said first position to said second position to charge said opening spring and said closing spring with operating energy while said switch operating member is latched by said latching means in said first position corresponding to the switch open position, said carriage being latched by said latching means when said carriage reaches said second position, subsequent release of said switch operating member by said latching means causing said switch operating member to move from said first position to said second position corresponding to the switch closed position, subsequent release of said carriage by said latching means causing said carriage to move from said second position to said first position; and means for moving said switch operating member from said second position to said first position in response to movement of said carriage from said second position to said first position.

27. An operating mechanism for a switch, the mechanism being of the type capable of storing energy to selectively close the switch when it is open, and being capable of immediately reopening the switch after its closure if such reopening is required, the mechanism opening and closing the switch by moving an operating member thereof in switch-opening and switch-closing directions; the mechanism comprising:

a frame;

a carriage movable in first and second opposed directions between first and second locations;

a first selectively releasable latch for preventing switch-closing movement of the operating member whenever the switch is open;

a first spring which acts between the carriage and the operating member so that movement of the carriage in the first direction while the first latch prevents switch-closing movement of the operating member stores therein switch-closing energy;

a second selectively releasable latch for preventing movement of the carriage in the second direction whenever the carriage has moved to the first location to store a selected amount of switch-closing energy in the first spring;

a second spring which acts between the carriage and the frame so that movement of the carriage to the first location stores therein a selected amount of switch-opening energy which biases the carriage in the second direction; and means for moving the operating member in the switch-opening direction in response to movement of the carriage in the second direction from the first to the second location whenever the switch is closed, whereby after energy is stored in said springs, said first latch is released and the operating member moves in the switch-closing direction, subsequent release of said second latch allowing said operating member to be moved in the switch-opening direction.

28. An operating mechanism for a switch, the mechanism being of the type capable of storing energy to selectively close the switch when it is open, and being capable of immediately reopening the switch after its closure if such reopening is required, the mechanism opening and closing the switch by moving an operating member thereof in switch-opening and switch-closing directions; the mechanism comprising:

a frame;

a carriage movable in first and second opposed directions between first and second locations;

a first selectively releasable latch for preventing switch-closing movement of the operating member whenever the switch is open;

a first spring which acts between the carriage and the operating member so that movement of the carriage in the first direction while the first latch prevents switch-closing movement of the operating member stores switch-closing energy in said first spring;

a second selectively releasable latch for preventing movement of the carriage in the second direction whenever the carriage has moved to the first location to store a selected amount of switch-closing energy in the first spring;

a second spring which acts between the carriage and the frame so that movement of the carriage to the first location stores therein a selected amount of switch-opening energy which biases the carriage in the second direction; and means for moving the operating member in the switch-opening direction in response to movement of the carriage in the second direction from the first to the second location whenever the switch is closed, whereby with the switch open and the carriage in the second location, the first latch prevents switch-closing movement of the operating member as the carriage is moved in the first direction to the first location, thereby storing switch-closing energy in the first spring and switch-opening energy in the second spring; subsequent release of the first latch permitting the first spring to move the operating member in the switch-closing direction to close the switch while the carriage is held by the second latch and the amount of energy stored in the second spring remains unchanged; subsequent release of the second latch with the switch closed permitting the second spring to move the carriage in the second direction to the second location and the operating member in the switch-opening direction to open the switch while the amount of energy stored in the first spring remains unchanged; whereafter movement of the carriage in the first direction restores energy in both springs.

* * * * *